US008953005B2

(12) United States Patent
Mimura

(10) Patent No.: US 8,953,005 B2
(45) Date of Patent: Feb. 10, 2015

(54) INK RIBBON CARTRIDGE AND IMAGE FORMING APPARATUS INCLUDING THE SAME

(71) Applicants: Kabushiki Kaisha Toshiba, Tokyo (JP); Toshiba TEC Kabushiki Kaisha, Tokyo (JP)

(72) Inventor: Toshifumi Mimura, Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/181,261

(22) Filed: Feb. 14, 2014

(65) Prior Publication Data

US 2014/0240432 A1 Aug. 28, 2014

(51) Int. Cl.

| | |
|---|---|
| ***B41J 2/325*** | (2006.01) |
| ***B41J 2/32*** | (2006.01) |
| ***B41J 2/38*** | (2006.01) |
| ***B41J 32/00*** | (2006.01) |

(52) U.S. Cl.

CPC ..... *B41J 2/325* (2013.01); *B41J 2202/37* (2013.01)

USPC ..... 347/179; 347/171; 347/187; 347/214

(58) Field of Classification Search

USPC ..... 347/179, 171, 187, 214

See application file for complete search history.

(56) References Cited

U.S. PATENT DOCUMENTS

2010/0097421 A1* 4/2010 Yoshida et al. ..... 347/14
2011/0234721 A1* 9/2011 Endo ..... 347/101

FOREIGN PATENT DOCUMENTS

JP 07285272 A * 10/1995 ..... B41M 5/30

* cited by examiner

*Primary Examiner* — Sarah Al Hashimi
(74) *Attorney, Agent, or Firm* — Patterson & Sheridan, LLP

(57) ABSTRACT

An ink ribbon cartridge includes an ink ribbon onto which decolorizable ink is applied, a transfer unit configured to thermally transfer the decolorizable ink on the ink ribbon to a recording medium such that an image is formed on the recording medium as the ink ribbon is conveyed, and a heating unit configured to heat a portion of the ink ribbon that has passed the transfer unit when the image was formed on the recording medium, at a temperature at which the decolorizable ink is decolorized.

20 Claims, 2 Drawing Sheets

INK RIBBON CARTRIDGE AND IMAGE FORMING APPARATUS INCLUDING THE SAME

CROSS-REFERENCE TO RELATED APPLICATION

This application is based upon and claims the benefit of priority from Japanese Patent Application No. 2013-036179, filed Feb. 26, 2013, the entire contents of which are incorporated herein by reference.

FIELD

Embodiments described herein relate to an ink ribbon cartridge to form an image on a recording medium and an image forming apparatus configured to form an image with such an ink ribbon cartridge.

BACKGROUND

As a way to preserve confidentiality of printed images, one type of an image forming apparatus that uses a thermal transfer ink ribbons melts the ink left on the ink ribbon or the ink ribbon itself after the image transferring process such that the image left on the ink ribbon cannot be recognized. Also, there exists image forming technology that allows a sheet with a printed image to be reused by printing with a decolorizable ink and erasing the printed image using heat. However, techniques for preserving confidentiality of images printed with decolorizable ink have not been developed.

DETAILED DESCRIPTION

In accordance with an embodiment, an ink ribbon cartridge includes an ink ribbon onto which decolorizable ink is applied, a transfer unit configured to thermally transfer the decolorizable ink on the ink ribbon to a recording medium such that an image is formed on the recording medium as the ink ribbon is conveyed, and a heating unit configured to heat a portion of the ink ribbon that has passed the transfer unit when the image was formed on the recording medium, at a temperature at which the decolorizable ink is decolorized.

Figure 1:
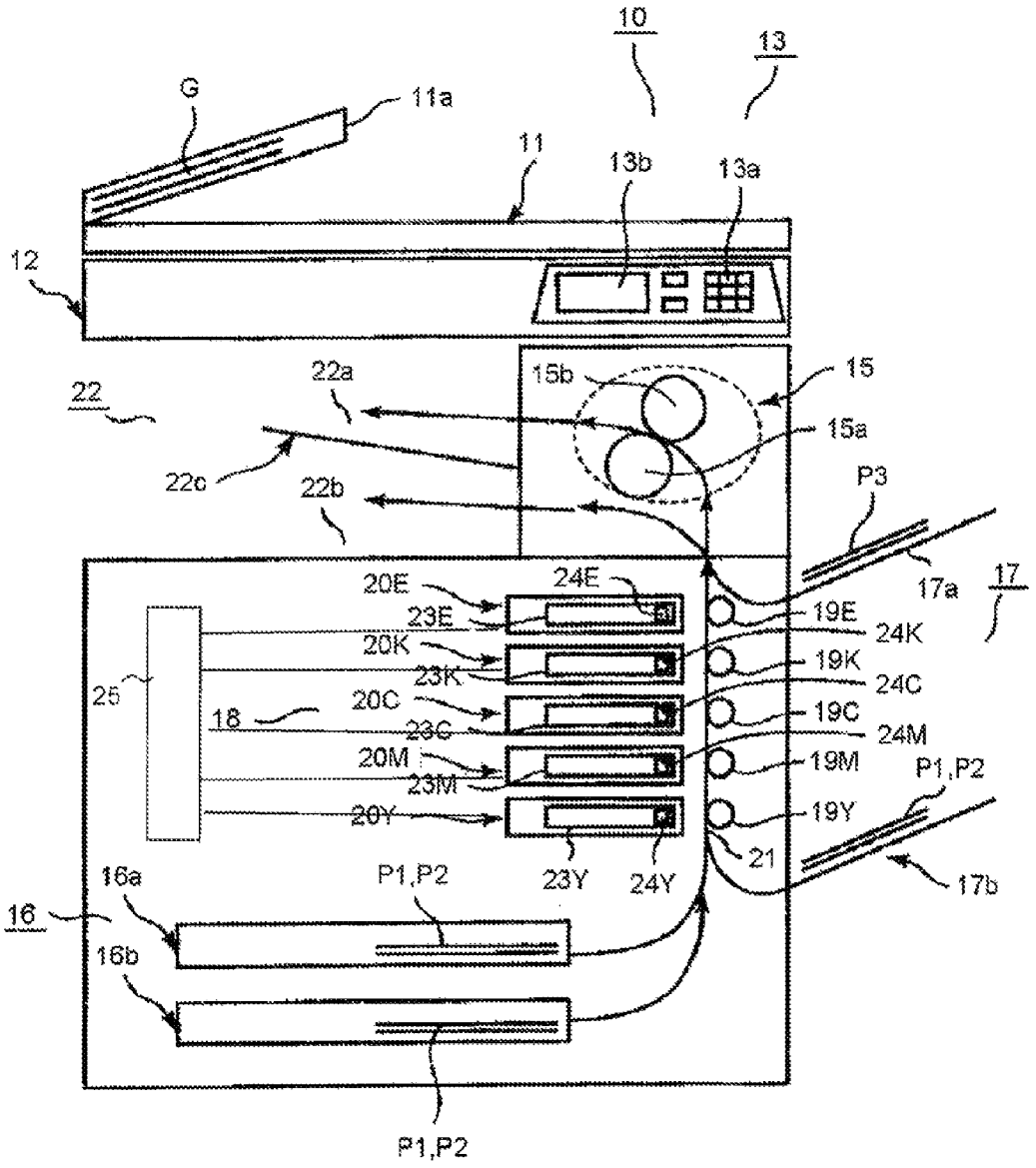
FIG. 1 is a schematic diagram illustrating the configuration of a multi function peripheral (MFP) according to an embodiment.
Figure 2:
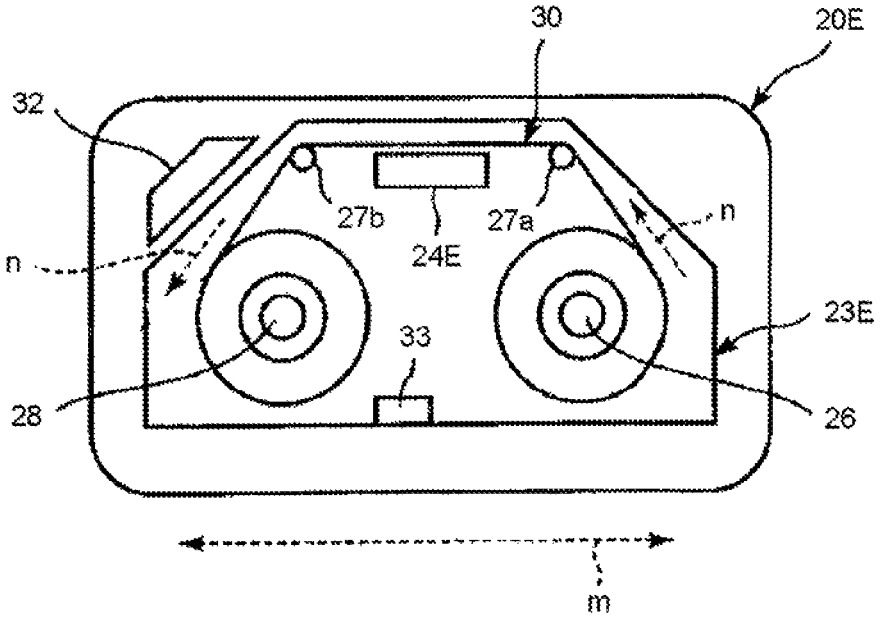
FIG. 2 is a schematic top view illustrating an ink ribbon cartridge container and an ink ribbon cartridge according to the embodiment.

Embodiments of the present invention are described below with reference to FIG. 1 and FIG. 2. FIG. 1 is a schematic diagram illustrating the configuration of a thermal transfer ink-ribbon-type multi-function peripheral (hereinafter referred to as MFP) 10 serving as an example of an image forming apparatus according to an embodiment. The MFP 10 comprises, for example, an automatic document feeder 11, a scanner 12, a control panel 13, an erasing section 15, paper feed sections 16 and 17, a printer section 18, and a paper discharge section 22. The MFP 10 carries out a printing operation with the printer section 18 in a printing mode and an erasing operation with the erasing section 15 in an erasing mode.

The automatic document feeder 11 feeds a document G placed in a document tray 11*a* to the scanner 12. The scanner

12 reads the image of the document G. The control panel 13 comprises, for example, an input key 13*a* and a touch panel type display section 13*b*. The input key 13*a* receives an input by, for example, a user. The display section 13*b* receives an input by, for example, a user or carries out a display for the user. The control panel 13 is operated to switch between the printing mode and the erasing mode of the MFP 10.

The erasing section 15 comprises, for example, a heat roller 15*a* and a press roller 15*b*. The erasing section 15 clamps and conveys a printed sheet P3 (a sheet the image of which is to be erased in the erasing section 15) in a nip between the heat roller 15*a* and the press roller 15*b*. The erasing section 15 heats and presses the printed sheet P3 at a temperature above an erasing temperature so as to erase the erasable ink image formed on the printed sheet P3.

The paper feed sections 16 and 17 comprise an upper paper feed cartridge 16*a*, a lower paper feed cartridge 16*b*, an upper manual paper feed tray 17*a*, and a lower manual paper feed tray 17*b*. For example, the upper paper feed cartridge 16*a*, the lower paper feed cartridge 16*b*, and the lower manual paper feed tray 17*b* can feed an unused sheet P1 or a reusable sheet P2 (a sheet the image of which has been erased through the erasing processing) serving as a recording medium. The upper manual paper feed tray 17*a* can feed, for example, the printed sheet P3.

A job separator 22*c* separates the paper discharge section 22 into an upper paper discharge section 22*a* and a lower paper discharge section 22*b*. A reusable sheet on which the printed image on which has been erased by the color erasing section 15 is discharged to the upper paper discharge section 22*a*. A printed sheet on which an image is printed by the printer section 18 is discharged to the lower paper discharge section 22*b*.

The printer section 18 comprises a conveyance path 21 extending from the upper paper feed cartridge 16*a*, the lower paper feed cartridge 16*b* or the lower manual paper feed tray 17*b* to the paper discharge section 22. The printer section 18 comprises Y (yellow), M (magenta), C (cyan), and K (black) non-decolorizable ink ribbon cartridge containers 20Y, 20M, 20C, and 20K along the conveyance path 21. The printer section 18 also comprises a decolorizable ink ribbon cartridge container 20E along the conveyance path 21.

The printer section 18 comprises platen rollers 19Y, 19M, 19C, and 19K, which are disposed opposite to the non-decolorizable ink ribbon cartridge containers 20Y, 20M, 20C, and 20K across the conveyance path 21. The printer section 18 also comprises a platen roller 19E, which is disposed opposite to the decolorizable ink ribbon cartridge container 20E across the conveyance path 21.

Y (yellow), M (magenta), C (cyan), and K (black) non-decolorizable ink ribbon cartridges 23Y, 23M, 23C, and 23K are respectively mounted in the Y (yellow), M (magenta), C (cyan), and K (black) non-decolorizable ink ribbon cartridge containers 20Y, 20M, 20C, and 20K. The non-decolorizable ink ribbon cartridges 23Y, 23M, 23C, and 23K contain ink ribbons formed by coating non-decolorizable inks the color of which cannot be decolorized by heating on a substrate such as a plastic film. The ink ribbon cartridges 23Y, 23M, 23C, 23K, and 23E are controlled in accordance with a program executed in central processing unit (CPU) 25. CPU 25 is programmed to perform various types of controls, including a control of feeding each of the ink ribbon cartridges 23Y, 23M, 23C, 23K, and 23E at a predetermined timing to a corresponding print head.

The decolorizable ink ribbon cartridge 23E of any color is mounted in the decolorizable ink ribbon cartridge container 20E. A decolorizable ink ribbon coated with a decolorizable ink is contained in the decolorizable ink ribbon cartridge 23E. The color of the decolorizable ink is decolorized when heated to a given temperature. No limitation is given to the color material used in the decolorizable ink as long as the color of the color material can be decolorized by heating. The decolorizable ink may be configured by properly combining a color material, a color developing agent, a color erasing material, and a color changing temperature adjusting agent such that the color is decolorized at a temperature above a certain temperature. Leuco dye, which is generally known, is used for the color material.

The leuco dye is an electron-releasing compound which can generate a color under the effect of a color developing agent. For example, the leuco dye may be diphenylmethanephthalides, phenylindolylphthalides, indolylphthalides, diphenylmethaneazaphthalides, phenylindolylazaphthalides, fluorans, styryl quinolines, and diazarhodamine lactones.

Specifically, the leuco dye is 3,3-Bis(p-dimethylaminophenyl)-6-dimethylaminophthalide,
3-(4-diethylaminophenyl)-3-(1-ethyl-2-methylindole-3-yl) phthalide,
3,3-Bis(1-n-butyl-2-methylindole-3-yl)phthalide,
3,3-Bis(2-ethoxy-4-diethylaminophenyl)-4-azaphthalide,
3-(2-ethoxy-4-diethylaminophenyl)-3-(1-ethyl-2-methylindole-3-yl)-4-azaphthalide,
3-[2-ethoxy-4-(N-ethylanilino)phenyl]-3-(1-ethyl-2-methylindole-3-yl)-4-azaphthalide,
3,6-diphenylaminofluoran,
3,6-dimethoxyfluoran,
3,6-di-n-butoxyfluoran,
2-methyl-6-(N-ethyl-N-p-tolylamino)fluoran,
2-N,N-dibenzylamino-6-diethylaminofluoran,
3-chloro-6-cyclohexylaminofluoran,
2-methyl-6-cyclohexylaminofluoran,
2-(2-chloroanilino)-6-di-n-butylaminofluoran,
2-(3-trifluoromethylanilino)-6-diethylaminofluoran,
2-(N-methylanilino)-6-(N-ethyl-N-p-tolylamino)fluoran,
1,3-dimethyl-6-diethylaminofluoran,
2-chloro-3-methyl-6-diethylaminofluoran,
2-anilino-3-methyl-6-diethylaminofluoran,
2-anilino-3-methyl-6-di-n-butylaminofluoran,
2-xylidino-3-methyl-6-diethylaminofluoran,
1,2-benz-6-diethylaminofluoran,
1,2-benz-6-(N-ethyl-N-isobutylamino)fluoran,
1,2-benz-6-(N-ethyl-N-isoamylamino)fluoran,
2-(3-methoxy-4-dodecoxystyryl)quinoline,
Spiro[5H-(1)benzopyrano(2,3-d)pyrimidine-5,1'(3'H) isobenzofuran]-3'-one,
2-(diethylamino)-8-(diethylamino)-4-methyl-spiro[5H-(1) benzopyrano(2,3-d)pyrimidine-5,1'(3'H)isobenzofuran]-3'-one,
2-(di-n-butylamino)-8-(di-n-butylamino)-4-methyl-Spiro [5H-(1)benzopyrano(2,3-d)pyrimidine-5,1'(3'H)isobenzofuran]-3'-one,
2-(di-n-butylamino)-8-(diethylamino)-4-methyl-spiro[5H-(1)benzopyrano(2,3-d)pyrimidine-5,1'(3'H)isobenzofuran]-3'-one,
2-(di-n-butylamino)-8-(N-ethyl-N-1-amylamino)-4-methyl-spiro[5H-(1)benzopyrano(2,3-d)pyrimidin-5,1'(3'H) isobenzofuran]-3'-one,
2-(di-n-butylamino)-8-(di-n-butylamino)-4-phenyl,
3-(2-methoxy-4-dimethylaminophenyl)-3-(1-butyl-2-methylindole-3-yl)-4,5,6,7-tetrachlorophthalide,
3-(2-ethoxy-4-diethylaminophenyl)-3-(1-ethyl-2-methylindole-3-yl)-4,5,6,7-tetrachlorophthalide, and
3-(2-ethoxy-4-diethylaminophenyl)-3-(1-pentyl-2-methylindole-3-yl)-4,5,6,7-tetrachlorophthalide.

The leuco dye may further be pyridine, quinazoline and bisquinazoline compounds. Two or more types of the leuco dye may be used together.

The color developing agent used in the embodiments described herein is an electron-accepting compound which provides leuco dye with protons. For example, the color developing agent may be phenols, phenol metal salts, metal salts of carvone acid, aromatic carboxylic acid and aliphatic carboxylic acid having 2 to 5 carbons, benzophenones, sulfonic acid, sulphonate, phosphoric acids, phosphoric acid metal salts, acidic phosphoric acid ester, acidic phosphoric acid ester metal salts, phosphorous acids, phosphorous acid metal salts, monophenols, polyphenols, 1,2,3-triazole, and derivative thereof. Furthermore, the color developing agent may also be a component having an alkyl group, an aryl group, an acyl group, an alkoxycarbonyl group, a carboxy group and esters thereof or an amide group, a halogen group, and the like serving as a substituent, and bis-phenol or tris-phenol, phenolaldehyde condensation resin, and metal salts thereof. Two or more kinds of color developing agent may be used together.

Specifically, the color developing agent is phenol,
o-cresol,
tertiary butylcatechol,
nonylphenol,
n-octylphenol,
n-dodecylphenol,
n-stearylphenol,
p-chlorophenol,
p-bromophenol,
o-phenylphenol,
n-butyl p-hydroxybenzoate,
n-octyl p-hydroxybenzoate,
benzyl p-hydroxybenzoate,
dihydroxybenzoic acid or esters thereof, for example,
2,3-dihydroxybenzoic acid,
methyl 3,5-dihydroxybenzoate,
resorcin,
gallic acid,
dodecyl gallate,
ethyl gallate,
butyl gallate,
propyl gallate,
2,2-Bis(4-hydroxyphenyl)propane,
4,4-dihydroxydiphenylsulfone,
1,1-Bis(4-hydroxyphenyl)ethane,
2,2-Bis(4-hydroxy-3-methylphenyl)propane,
Bis(4-hydroxyphenyl)sulfide,
1-phenyl-1,1-Bis(4-hydroxyphenyflethane,
1,1-Bis(4-hydroxyphenyl)-3-methylbutane,
1,1-Bis(4-hydroxyphenyl)-2-methylpropane,
1,1-Bis(4-hydroxyphenyl)-n-hexane,
1,1-Bis(4-hydroxyphenyl)-n-heptane,
1,1-Bis(4-hydroxyphenyl)-n-octane,
1,1-Bis(4-hydroxyphenyl)-n-nonane,
1,1-Bis(4-hydroxyphenyl)-n-decane,
1,1-Bis(4-hydroxyphenyl)-n-dodecane,
2,2-Bis(4-hydroxyphenyl)butane,
2,2-Bis(4-hydroxyphenyl)ethylpropionate,
2,2-Bis(4-hydroxyphenyl)-4-methylpentane,
2,2-Bis(4-hydroxyphenyl)hexafluoropropane,
2,2-Bis(4-hydroxyphenyl)-n-heptane,
2,2-Bis(4-hydroxyphenyl)-n-nonane,
2,4-dihydroxyacetophenone, 2,5-dihydroxyacetophenone,
2,6-dihydroxyacetophenone,
3,5-dihydroxyacetophenone,
2,3,4-trihydroxyacetophenone,
2,4-dihydroxybenzophenone,
4,4'-dihydroxybenzophenone,
2,3,4-trihydroxybenzophenone,
2,4,4'-trihydroxybenzophenone,
2,2',4,4'-tetrahydroxybenzophenone,
2,3,4,4'-tetrahydroxybenzophenone,
2,4'-biphenol,
4,4'-biphenol,
4-[(4-hydroxyphenyl)methyl]-1,2,3-benzenetriol,
4-[(3,5-dimethyl-4-hydroxyphenyl)methyl]-1,2,3-benzenetriol,
4,6-Bis[(3,5-dimethyl-4-hydroxyphenyl)methyl]-1,2,3-benzenetriol,
4,4-[1,4-phenylenebis(1-methylethylidene)Bis(benzene-1,2,3-triol)],
4,4-[1,4-phenylenebis(1-methylethylidene)Bis(1,2-benzenediol)],
4,4',4"-ethylidenetrisphenol,
4,4'-(1-methylethylidene)bisphenol, and
methylenetris-p-cresol.

The decolorizing agent used in the embodiment described herein may be any well-known decolorizing agent that can hinder the color generation reaction based on the leuco dye and the color developing agent by heating and decolorize the color in a three-component system comprising a color generation compound, a color developing agent, and a decolorizing agent. The decolorizing agent may be alcohols, esters, ketones, ethers, and acid amides. These may be used as a mixture of two or more.

The non-decolorizable ink ribbon cartridge containers 20Y, 20M, 20C, and 20K comprise print heads 24Y, 24M, 24C, and 24K, respectively. The decolorizable ink ribbon cartridge container 20E comprises a print head 24E serving as a thermal transfer section.

The decolorizable ink ribbon cartridge container 20E and the decolorizable ink ribbon cartridge 23E are described in detail with reference to FIG. 2. The decolorizable ink ribbon cartridge 23E contains a decolorizable ink ribbon 30 which extends from a winding roller 28 to a feed roller 26 through tension rollers 27*a* and 27*b*. The decolorizable ink ribbon cartridge 23E has an IC chip 33 which stores various types of management information such as expiration management information, the number of printings of the decolorizable ink ribbon cartridge 23E, and security management information for piracy prevention.

The print head 24E is located opposite to the decolorizable ink ribbon 30 between the tension rollers 27*a* and 27*b* of the mounted decolorizable ink ribbon cartridge 23E. The decolorizable ink ribbon cartridge container 20E is reciprocated in a direction indicated by an arrow m based on the widths (widths of the sheets P1 and P2 in a direction vertical to the conveyance direction of the sheets P1 and P2) of the sheets P1 and P2.

The print heat 24E thermally transfers the decolorizable ink onto the sheet P1 or P2 to form a printing image thereon with the decolorizable ink. The MFP 10 sets the thermal transfer temperature of the print head 24E to be lower than a decolorizing temperature at which the color of the decolorizable ink is decolorized. The print heat 24E is controlled to generate heats with respect to decolorizable printing information (images to be formed with the decolorizable ink and to thermally transfer the decolorizable ink on the decolorizable ink ribbon 30 onto the sheet P1 or P2. In the process of transferring the decolorizable printing information, the print heads 24Y, 24M, 24C, and 24K do not operate. The non-decolorizable ink does not remains on the sheet to be reused when erasing the printed image, because the non-decolorizable ink does not adhere on the image printed with the decolorizable ink. As a result, a poor decolorizing can be prevented.

The decolorizable ink ribbon cartridge container 20E comprises a heater 32 serving as a heating section. The decolorizable ink ribbon 30 of the decolorizable ink ribbon cartridge 23E extending from the tension roller 27*b* to the winding roller 28 is opposite to the heater 32. The heater 32 heats the decolorizable ink ribbon 30 to a temperature above the decolorizing temperature of the decolorizable ink and decolorizes the color of the decolorizable ink left on the decolorizable ink ribbon 30 after the thermal transferring processing.

Except for not having the heater 32, the configuration of the non-decolorizable ink ribbon cartridge containers 20Y, 20M, 20C, and 20K of the printer section 18 are the same as that of the decolorizable ink ribbon cartridge container 20E. Therefore, the description of the non-decolorizable ink ribbon cartridge containers 20Y, 20M, 20C, and 20K with reference to drawings is omitted.

Like the decolorizable ink ribbon cartridge container 20E, the non-decolorizable ink ribbon cartridge containers 20Y, 20M, 20C, and 20K reciprocate in the width direction based on the widths of the sheets P1 and P2. The print head 24Y, 24M, 24C, or 24K thermally transfers its own color inerasable ink onto the sheet P1 or P2 to form a printing image thereon with the color inerasable ink.

The MFP 10 sets the heating temperature of each of the print heads 24Y, 24M, 24C, and 24*k* to a temperature at which the non-decolorizable ink of the non-decolorizable ink ribbon can be thermally transferred successfully. Each print head 24Y, 24M, 24C, and 24K thermally transfers the non-decolorizable ink of its own non-decolorizable ink ribbon onto the sheet P1 or P2 only when there is printing information relating to its own color, thereby preventing the waste on non-decolorizable ink ribbons when there is no such printing information.

With the configuration above, in a printing mode, the MFP 10 forms, using the printer section 18, a printing image on the sheet P1 or P2 according to the printing information. If the image to be printed includes confidential information which needs to be erased after being used, the printer section 18 thermally transfers a color erasable ink onto the sheet P1 or P2 with the print head 24E to form the image. After the image is formed, the MFP 10 discharges the sheet P1 or P2 to the lower paper discharge section 22*b*.

The decolorizable ink ribbon cartridge container 20E winds the decolorizable ink ribbon 30 in a direction indicated by an arrow n with the winding roller 28 as the printing operation is continued. The heater 32 heats a portion of the decolorizable ink ribbon 30 to a temperature above the decolorizing temperature during the period in which the decolorizable ink ribbon 30 is wound by the winding roller 28. After the image is thermally transferred, the heater 32 erases the print trace left on the color erasable ink ribbon 30. Thus, the print trace is not left on the decolorizable ink ribbon 30, and cannot be recognized from the color erasable ink ribbon 30 wound around the winding roller 28.

When the printing information does not include confidential information, the printer section 18 thermally transfers a non-decolorizable ink of a desired color onto the sheet P1 or P2 with the print head 24Y, 24M, 24C, or 24K to form an image. After the image is formed, the MFP 10 discharges the sheet P1 or P2 to the lower paper discharge section 22*b*.

After the thermal transfer, the non-decolorizable ink ribbon cartridge container 20Y, 20M, 20C, or 20K winds the ink ribbon in the non-decolorizable ink ribbon cartridge 23Y, 23M, 23C, or 20K without heating the ink ribbon.

For example, to obtain a reusable sheet, the user operates the control panel 13 to switch the MFP 10 from the printing mode to the erasing mode in which the MFP 10 feeds a printed sheet P3 from the upper manual paper feed tray 17*a* to the erasing section 15. The erasing section 15 heats and presses the printed sheet P3 at a temperature above a decolorizing temperature to erase the image printed on the printed sheet P3 with a decolorizable ink. After the erasing processing, the MFP 10 discharges the printed sheet P3 to the upper paper discharge section 22*a* as a reusable sheet.

According to the embodiment, the erasable ink ribbon 30 passing through the print head 24E is heated by the heater 32 to a temperature above the decolorizing temperature of the decolorizable ink. The print trace left on the decolorizable ink ribbon 30 during a thermal transfer cannot be recognized as the print trace on decolorizable ink ribbon 30 is erased after the image is thermally transferred. In this way, the printed image cannot be recognized from the print trace left on the decolorizable ink ribbon 30. Thus, the printed image can be kept confidential. According to the embodiment, the information can be kept confidential by decolorizing the decolorizable ink at a heating temperature lower than a melting temperature, without melting the decolorizable ink or substrate of the decolorizable ink ribbon 30.

No limitation is given to the configuration of the image forming apparatus according to the embodiment described above. The image forming apparatus may be an apparatus which forms an image with decolorizable ink ribbons of a plurality of colors or an apparatus provided without non-decolorizable ink ribbon. No limitation is given to the heating temperature of the heating section of the image forming apparatus applied to the decolorizable ink. Further, no limitation is given to the shape or arrangement of the heating section. For example, in the embodiment described herein, the heating section may be a heat roller that is configured to contact with the decolorizable ink ribbon 30. Alternatively, in the embodiment described herein, a heater can be arranged in the core of the winding roller 28 as the heating section. The heater arranged in the core of the winding roller 28 heats the used decolorizable ink ribbon such that the color of the decolorizable ink is decolorized. The used decolorizable ink ribbon cartridge 23E is replaced with a new one after the decolorizable ink on the used ribbon is decolorized.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink ribbon cartridge, comprising:

an ink ribbon onto which decolorizable ink is applied;

a transfer unit configured to thermally transfer the decolorizable ink on the ink ribbon to a recording medium such that an image is formed on the recording medium as the ink ribbon is conveyed; and a heating unit configured to heat a portion of the ink ribbon that has passed the transfer unit when the image was formed on the recording medium, at a temperature at which the decolorizable ink is decolorized.

2. The ink ribbon cartridge according to claim 1, further comprising:

a feeding roller around which the ink ribbon is initially wound; and a winding roller around which the portion of the ink ribbon that has passed the transfer unit is wound.

3. The ink ribbon cartridge according to claim 2, wherein the heating unit is configured to heat the portion of the ink ribbon before the portion is wound around the winding roller.

4. The ink ribbon cartridge according to claim 3, wherein the heating unit is disposed along the portion of the ink ribbon between the transfer unit and the winding roller.

5. The ink ribbon cartridge according to claim 2, wherein the heating unit is configured to heat the portion of the ink ribbon after the portion is wound around the winding roller.

6. The ink ribbon cartridge according to claim 2, wherein the heating unit is included in the winding roller.

7. The ink ribbon cartridge according to claim 1, wherein the heating unit is configured to heat the portion of the ink ribbon such that the image formed on the portion of the ink ribbon with the decolorizable ink is erased.

8. An image forming apparatus, comprising:

an ink ribbon cartridge including:

an ink ribbon onto which decolorizable ink is applied, and a transfer unit configured to thermally transfer the decolorizable ink on the ink ribbon to a recording medium such that an image is formed on the recording medium as the ink ribbon is conveyed;

a heating unit configured to heat a portion of the ink ribbon that has passed the transfer unit when the image was formed on the recording medium, at a temperature at which the decolorizable ink is decolorized; and a control unit configured to control the ink ribbon cartridge to form the image based on the image data.

9. The image forming apparatus according to claim 8, wherein the ink ribbon cartridge further includes, a feeding roller around which the ink ribbon is initially wound, and a winding roller around which the portion of the ink ribbon that has passed the transfer unit is wound.

10. The image forming apparatus according to claim 9, wherein the heating unit is configured to heat the portion of the ink ribbon before the portion is wound around the winding roller.

11. The image forming apparatus according to claim 10, wherein the heating unit is disposed along the portion of the ink ribbon between the transfer unit and the winding roller.

12. The image forming apparatus according to claim 9, wherein the heating unit is configured to heat the portion of the ink ribbon after the portion is wound around the winding roller.

13. The image forming apparatus according to claim 12, wherein the heating unit is disposed so as to be located in the winding roller of the ink ribbon cartridge.

14. The image forming apparatus according to claim 8, wherein the heating unit is configured to heat the portion of the ink ribbon such that the image formed on the portion of the ink ribbon with the decolorizable ink is erased.

15. The image forming apparatus according to claim 8, further comprising:

a non-decolorizable ink ribbon cartridge configured to cause an image to be formed on the recording medium with non-decolorizable ink.

16. The image forming apparatus according to claim 15, wherein the control unit is configured to control the ink ribbon cartridge to form the image when the image includes confidential information and control the non-decolorizable ink ribbon cartridge when the image does not include confidential information.

17. A method for forming an image on a recording medium, comprising:

conveying an ink ribbon onto which decolorizable ink is applied;

transferring the decolorizable ink on the ink ribbon to the recording medium such that an image is formed on the recording medium; and heating a portion of the ink ribbon from which the decolorizable ink has been transferred when the image was formed on the recording medium, at a temperature at which the decolorizable ink is decolorized.

18. The method according to claim 17, wherein the ink ribbon is conveyed from a feeding roller to a winding roller, and the portion of the ink ribbon is heated before the portion is wound around the winding roller.

19. The method according to claim 17, wherein the ink ribbon is conveyed from a feeding roller to a winding roller, and the portion of the ink ribbon is heated after the portion is wound around the winding roller.

20. The method according to claim 17, further comprising:

determining whether or not an image to be transferred to the recording medium includes confidential information, wherein the conveying of the ink ribbon, the transferring of the decolorizable ink, and the heating of the portion of the ink ribbon are performed after it is determined that the image to be transferred to the recording medium includes confidential information.

* * * * *